US006842908B1

(12) United States Patent
Saito

(10) Patent No.: US 6,842,908 B1
(45) Date of Patent: Jan. 18, 2005

(54) STAB PROOF VEST

(75) Inventor: Hisao Saito, Tokyo (JP)

(73) Assignee: Yugen Gaisha Kuroiwa Kogyo, Tokyo (JP)

( * ) Notice: Subject to any disclaimer, the term of this patent is extended or adjusted under 35 U.S.C. 154(b) by 0 days.

(21) Appl. No.: 10/743,462

(22) Filed: Dec. 23, 2003

(30) Foreign Application Priority Data

Jul. 2, 2003 (JP) ..... 2003-270351

(51) Int. Cl.[7] ..... F41H 1/02
(52) U.S. Cl. ..... 2/2.5; 2/463
(58) Field of Search ..... 2/2.12, 2.5, 463, 2/455, 456, 464, 465; 89/36.01, 36.05; 428/33, 223, 52, 911, 912; 442/134, 135

(56) References Cited

U.S. PATENT DOCUMENTS 377,732 A * 2/1888 Adams ..... 2/2.5
642,649 A * 2/1900 Vaughan ..... 2/2.5
1,021,804 A * 4/1912 Schneider ..... 160/218
3,867,239 A * 2/1975 Alesi et al. ..... 428/48
4,442,150 A * 4/1984 Greiner et al. ..... 428/53
4,843,947 A * 7/1989 Bauer et al. ..... 89/36.05
5,306,532 A * 4/1994 Tsien et al. ..... 428/33
5,601,895 A * 2/1997 Cunningham ..... 428/66.6
5,853,863 A * 12/1998 Kim ..... 428/223
6,159,590 A * 12/2000 Kim ..... 428/223
6,189,157 B1 * 2/2001 Ziegler ..... 2/455

FOREIGN PATENT DOCUMENTS

JP 14(1939)559 1/1939

* cited by examiner

*Primary Examiner*—Danny Worrell
(74) *Attorney, Agent, or Firm*—Greenblum & Bernstein, P.L.C.

(57) ABSTRACT

A stab proof vest, wherein at least a portion of the stab proof vest includes a plurality of elements, and a coupling member for coupling adjacent the elements together. Each side of the elements is provided with at least one projection and at least one depression adjacent to the projection, and a coupling hole into which the coupling member is inserted. The projection of one element is engaged with the depression of an adjacent element. The common coupling member is inserted into each the hole of adjacent elements and is secured thereto in order to couple the adjacent elements.

13 Claims, 13 Drawing Sheets

STAB PROOF VEST

BACKGROUND OF THE INVENTION

1. Field of the Invention

The present invention relates to a stab proof vest for protecting a wearer against an attacker possessing a sharp object such as a knife, which can be effectively worn by a taxi driver, a guard, a clerk at a convenience store, a bank clerk, a police officer, etc.

2. Description of the Related Art

Japanese Utility Model Publication No. 14(1939)-559 discloses a stab proof protective gear which protects a wearer against an attacker possessing a sharp object such as a knife. The stab proof protective gear has two steel plates having thickness of a few centimeters which are disposed in the front and back of the wearer.

In the above stab proof protective gear, though an edge tool does not penetrate the steel plate due to the thickness thereof, the protective gear is too heavy to wear for a long period of time. Moreover, since the two steel plates just sandwich the wearer at the front and back and do not cover either side of the wearer, the sides of the wearer cannot be protected from being stabbed.

SUMMARY OF THE INVENTION

According to an aspect of the present invention, a stab proof vest, wherein at least a portion of the stab proof vest includes a plurality of elements, and a coupling member for coupling adjacent the elements together. Each side of the elements is provided with at least one projection and at least one depression adjacent to the projection, and a coupling hole into which the coupling member is inserted. The projection of one of the element is engaged with the depression of an adjacent the element. The common coupling member is inserted into each the hole of adjacent the elements and is secured thereto in order to couple the adjacent elements.

It is desirable for the coupling member couples four elements arranged in two columns and two rows.

It is desirable for the stab proof vest to be fastened by hook and loop fasteners provided on front and back faces of the stab proof vest.

It is desirable for the element to be made of stainless steel.

The element can be provided with an air vent.

It is desirable for the projection and the depression to be asymmetrically provided on at least one of two pairs of opposite sides of the element.

It is desirable for the coupling member to include a rectangular main portion, and arm portions provided at both ends of the main portion and extending perpendicularly to the main portion. The coupling member has a shape of a letter "H."

It is desirable for the two of the coupling holes to be formed in each side of the element, and for the arm portions of the coupling member to be inserted into the coupling holes to couple adjacent the elements together.

The coupling member can be made of stainless steel.

It is desirable for the at least a portion of the stab proof vest to be covered with an elastic member.

It is desirable for a thickness of the element to be in a range of 0.5 mm to 2 mm.

Each of the elements can have the same shape.

It is desirable for at least one of a front body portion and a back body portion to include a single plate member.

The present disclosure relates to subject matter contained in Japanese Patent Application No. 2003-270351 (filed on Jul. 2, 2003) which is expressly incorporated herein by reference in its entirety.

BRIEF DESCRIPTION OF THE DRAWINGS

The present invention will be discussed below in detail with reference to the accompanying drawings, in which.

DETAILED DESCRIPTION OF THE PREFERRED EMBODIMENTS

First Embodiment

A stab proof vest (a stab proof jacket) 10 according to the present invention is used for protecting a wearer against an attacker (criminal) possessing a sharp object such as a knife. The stab proof vest 10 comprises elements (rectangular elements) 20 which are coupled vertically and horizontally. The first embodiment of the present invention will be hereinafter described in detail with reference to the accompanying drawings.

Figure 1A:
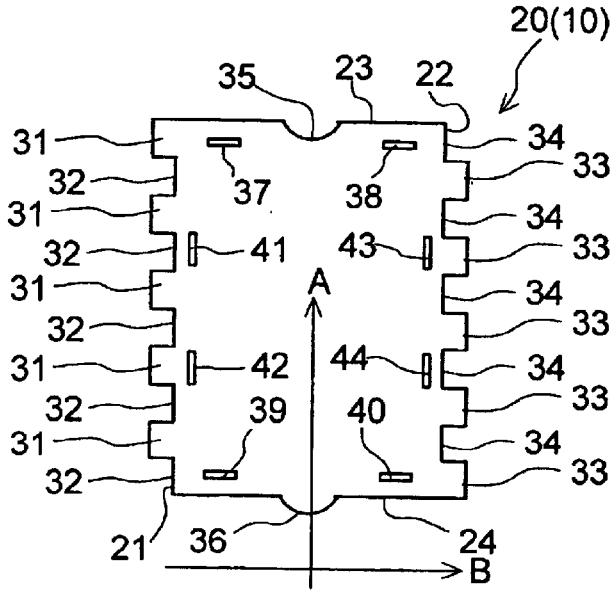
FIG. 1A is a plan view of an element of a stab proof vest, according to a first embodiment of the present invention.
Figure 1B:
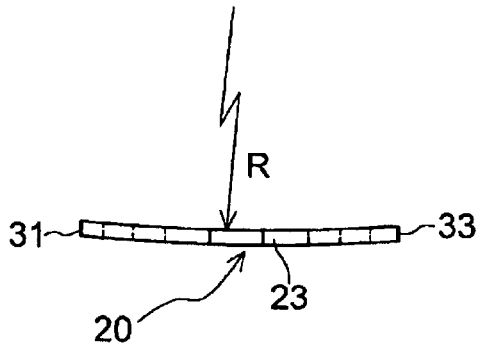
FIG. 1B is a side view of the element of the stab proof vest.
Figure 7:
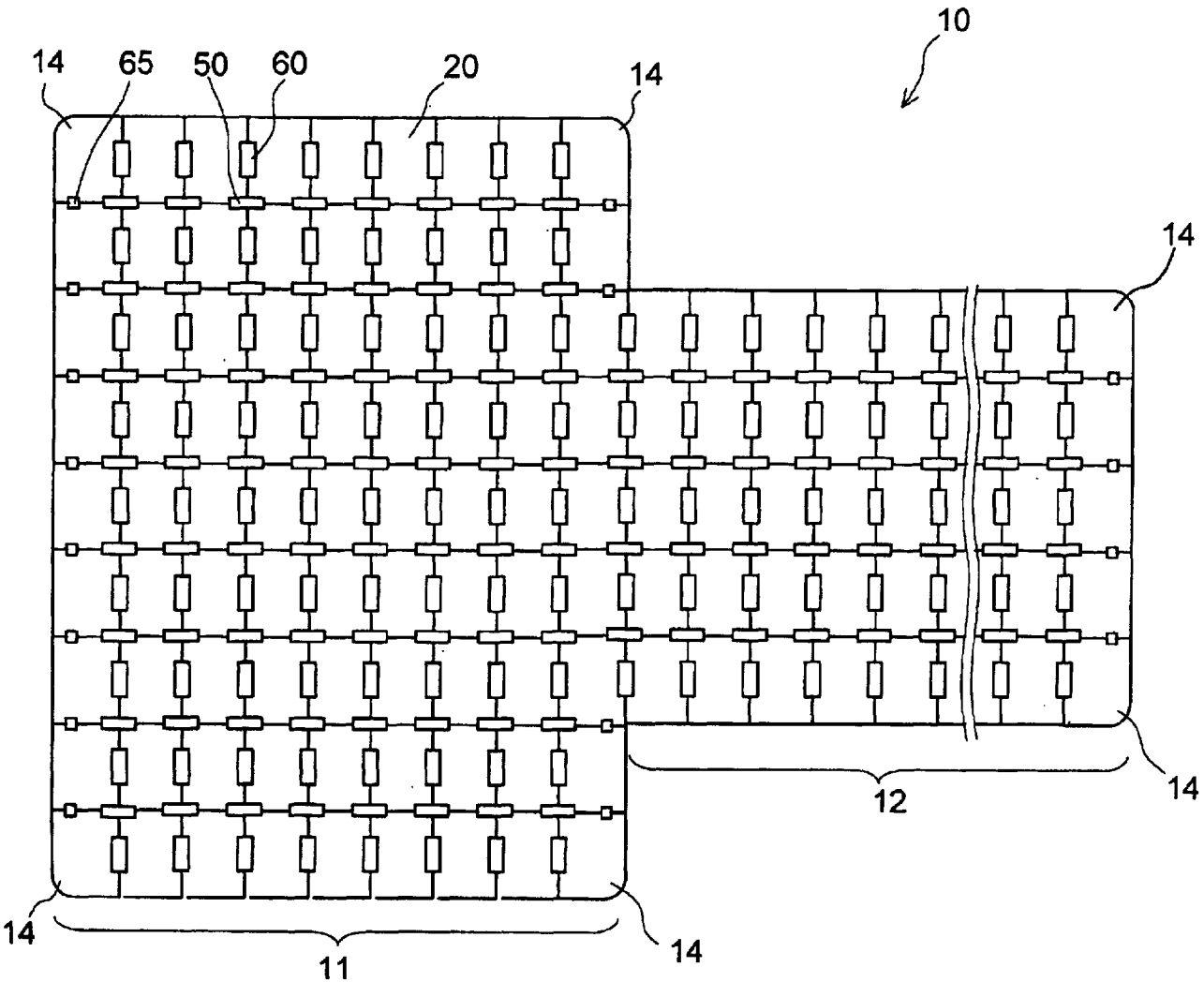
FIG. 7 is a plan view of the stab proof vest in which the elements thereof are completely coupled together.

FIGS. 1A and 1B show an element 20 (of the stab proof vest 10 shown in FIG. 7). The element 20 is an approximately rectangle-shaped stainless steel plate which has been press-formed. According to an experiment carried out by the inventor of the present invention, even when the element 20 having a thickness of 0.8 mm is stabbed with great force using a knife, the tip of the knife does not penetrate the element 20. It is apparent from the experiment that the element 20 has high resistance to stabbing. On the other hand, it is desirable that the element 20 is thin and lightweight so that the stab proof vest 10 (which constructed from a plurality of the elements 20) is suitable for wearing for a period of long time. Accordingly, in consideration of a balance between resistance to stabbing and weight, it is desirable that the thickness of the element 20 is approximately 0.5 to 2 mm, and a range of 0.5 to 1 mm is more desirable. When the thickness of the element 20 is within the above-mentioned range, the wearer can easily wear the stab proof vest 10 between outerwear and underwear, or under the underwear. Since the stainless steel has high resistance to corrosion, the element 20 of stainless steel is not subject to corrosion by human sweat even if a stab proof vest 10 is worn for a long time. The element 20 has little or no adverse effect on the human body. The element 20 is made of stainless steel in this embodiment, but can be made of another material such as aluminum, acryl resin, polycarbonate, CFRP (carbon fiber reinforced plastic), and GFRP (glass fiber reinforced plastic), as long as the material has both resistance to stabbing and light weight.

The element 20 has a pair of long sides 21 and 22 extending in a vertical direction (in direction A of FIG. 1A). A plurality of rectangular projections 31 and 33, protruding outward in a horizontal direction (in direction B of FIG. 1A), are vertically provided in the long sides 21 and 22, respectively. Rectangular depressions 32 are formed between the adjacent projections 31. Likewise, rectangular depressions 34 are formed between the adjacent projections 33.

Figure 2:
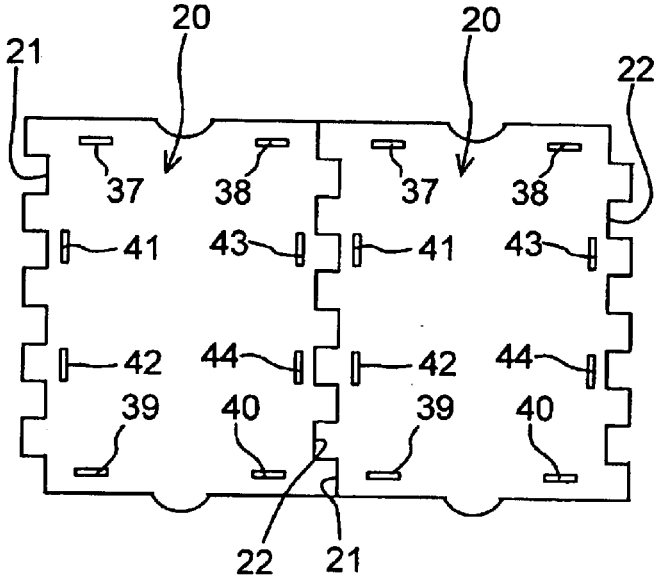
FIG. 2 is a plan view of the elements constituting the stab proof vest according to the first embodiment which are arranged in a horizontal direction.

The projections 31 and depressions 32 are alternately arranged along the long side 21, and the widths of the projections 31 in the vertical direction are the same as those of the depressions 32. Likewise, the projections 33 and the depressions 34 are alternately arranged along the long side 22, and the widths of the projections 33 in the vertical direction are the same as those of the depressions 34. Accordingly, as shown in FIG. 2, the projections 31 are inserted into and engaged with the depressions 34 of an adjacent element 20, and the projections 33 are inserted into and engaged with the depressions 32 of an adjacent element 20, to couple (connect) the adjacent elements 20 together. As described above, since the elements 20 are coupled by the engagement between the projections 31 and the depressions 34, or between the projections 33 and the depressions 32, a linear gap is not left between the adjacent elements 20, so that it is possible to prevent a tip of a knife from piercing through the gap between the adjacent elements 20.

The projections 31 and the depressions 34 are asymmetrically provided on opposite sides of the element 20, and the depressions 32 and the projections 33 are likewise asymmetrically provided on opposite sides of the element 20. Namely, one of the projections 31 is provided at an uppermost portion of the long side 21, and one of the depressions 32 provided at a lowermost portion of the long side 21. Likewise, one of the depressions 34 is provided at an uppermost portion of the long side 22, and one of the projections 33 is provided at a lowermost portion of the long side 22. Therefore, when a plurality of elements 20 are aligned in the horizontal direction in such a manner that the long side 21 is on the left and the long side 22 is on the right (or the long side 21 is on the right and the long side 22 is on the left), the projections 31 and 33 are inserted into and engaged with the depressions 34 and 32 of the adjacent elements 20, respectively, so that the elements 20 are coupled and arranged in line without leaving any gap. According to such an arrangement of the projections 31 and 33 and depressions 32 and 34, the long side 21 cannot be engaged with the long side 21 of an adjacent element 20, and the long side 22 cannot be engaged with the long side 22 of an adjacent element 20. Accordingly, when the element 20 is curved (bent) so as to fit a human body, as shown in FIG. 1B, it is unnecessary to confirm the direction of curvature whenever the element 20 is coupled furthermore, the elements 20 are formed into the same shape, so that the cost for dies is reduced.

Although the plurality of projections 31 and depressions 32, and the plurality of projections 33 and depressions 34 are provided in the embodiment shown in FIG. 1A, one projection and one corresponding depression can be alternatively provided one each long side 21 and 22 in order to couple the adjacent elements 20. The shape of the projections 31 and 33 and the depressions 32 and 34 can be an arc, instead of a rectangle, as long as the projections 31 and 33 are engageable with the depressions 32 and 34, respectively. The projection 31 or the depression 34 may not be provided at an uppermost position, and the depression 32 or the projection 33 may not be provided at a lowermost position, as long as the projections (31 and 32) and depressions (33 and 34) are formed at corresponding positions on the long sides 21 and 22.

Figure 3:
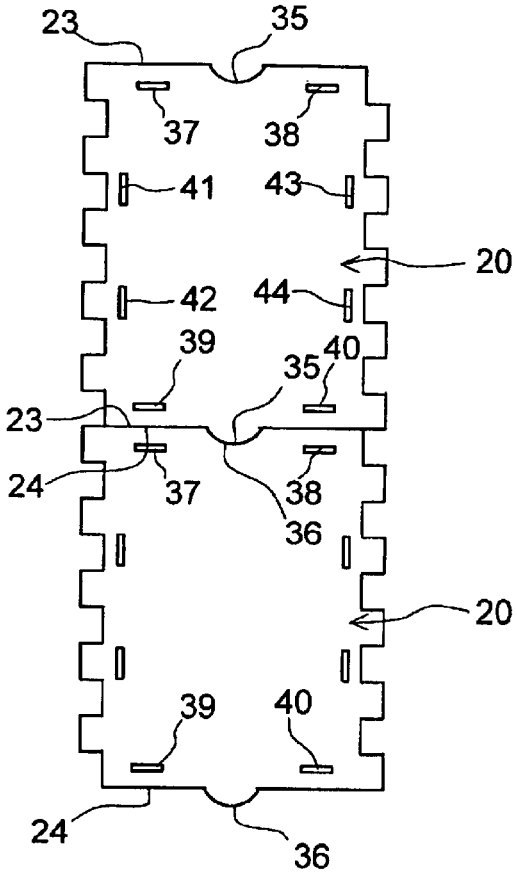
FIG. 3 is a plan view of the elements of the stab proof vest according to the first embodiment which are arranged in a vertical direction.

A pair of short sides 23 and 24 of the element 20 extends in the horizontal direction. An arc-shaped depression 35 is formed in the middle of the short side 23. An arc-shaped projection 36 having the shape corresponding with the depression 35 is formed in the middle of the short side 24 (refer to FIG. 1A). In FIG. 3, when the projection 36 is inserted into and engaged with the depression 35 of the vertically adjacent element 20, a plurality of the elements 20 are vertically aligned without leaving any gap. Since the elements 20 are coupled by the engagement of the depression 35 and the projection 36, there is no linear gap left between an adjacent elements 20, so that an edge of an edge tool does not enter through the gap. The short side 23 cannot be engaged with the short side 23 of an adjacent element 20, and the short side 24 cannot be engaged with the short side 24 of an adjacent element 20. Therefore, it is possible to prevent the element 20 from being engaged in an improper manner.

Although one depression 35 and one projection 36 are provided in FIG. 1A, a plurality of depressions and a corresponding plurality of projections can be provided on the short sides 23 and 24, respectively. The shape of the depression 35 and the projection 36 can be rectangular, instead of an arc, as long as the projection 36 is engageable with the depression 35.

Coupling holes 37 and 38 for inserting a coupling member thereinto are formed at one vertical end (the upper end as shown in FIG. 1A) of the element 20, and coupling holes 39 and 40 are formed in the other vertical end (the lower end as shown in FIG. 1A) thereof. The coupling holes 37 through 40 are rectangular openings having the same shape. When the elements 20 are horizontally aligned, the coupling holes 37 and 39 are symmetrical to the coupling holes 38 and 40 of the adjacent element 20 (refer to FIG. 2). When the elements 20 are vertically aligned, the coupling holes 37 and 38 are symmetrical to the coupling holes 39 and 40 of an adjacent element 20 (refer to FIG. 3).

Coupling holes 41 and 42 for inserting a coupling member thereinto are formed at one horizontal end (the left end as shown in FIG. 1A) of the element 20, and coupling holes 43 and 44 are formed at the other horizontal end (the right end as shown in FIG. 1A) of the element 20. The coupling holes 41 to 44 are rectangular openings having the same size and shape. When the elements 20 are horizontally aligned, the coupling holes 41 and 42 are symmetrical to the coupling holes 43 and 44 of the adjacent element 20. Since the size and shape of the coupling holes 37 to 40 and the coupling holes 41 to 44 are the same, and the distance between the coupling hole 37 and the coupling hole 38 of the adjacent element 20 (the coupling hole 39 and the coupling hole 40 of an adjacent element 20) is the same as the distance between the coupling holes 41 and 42 (the coupling holes 43 and 44) in a single element 20, a common coupling member can be used so that the cost can be reduced.

Figure 4A:
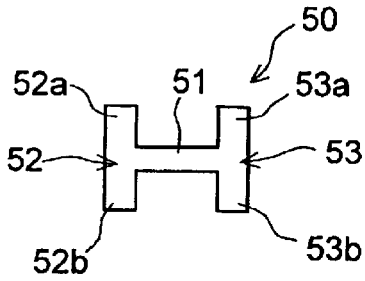
FIG. 4A is a plan view of a coupling member for coupling four elements of the stab proof vest, according to the first embodiment, which are arranged in two columns and two rows.
Figure 4B:
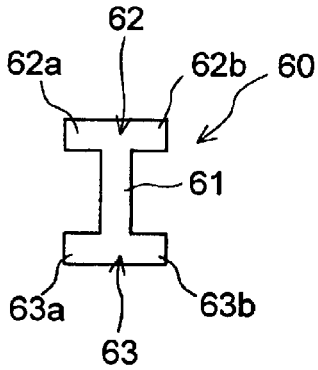
FIG. 4B is a plan view of another coupling member for coupling two elements of the stab proof vest in the horizontal direction.
Figure 4C:
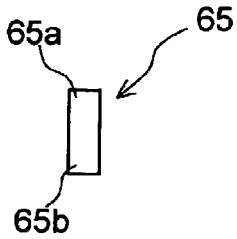
FIG. 4C is a plan view of further another coupling member for coupling two elements of the stab proof vest in the vertical direction.

As shown in FIGS. 4A, 4B, and 4C, coupling members 50, 60 and 65 made of stainless steel are used for coupling the elements 20. The coupling member 50 couples four elements 20 which are arranged in two columns and two rows. The coupling member 50, press-formed into the shape of a letter "H", includes a rectangular main portion 51 extending horizontally, and rectangular arm portions 52 and 53 extending vertically which are disposed in both ends of the main portion 51. The distance between the arm portions 52 and 53 corresponds with the distance between the coupling hole 37 and the coupling hole 38 of an adjacent element 20 (the coupling hole 39 and the coupling hole 40 of an adjacent element 20). The width of the arm portions 52 and 53 in the horizontal direction is almost the same as the width of the coupling holes 37 to 40.

Figure 5:
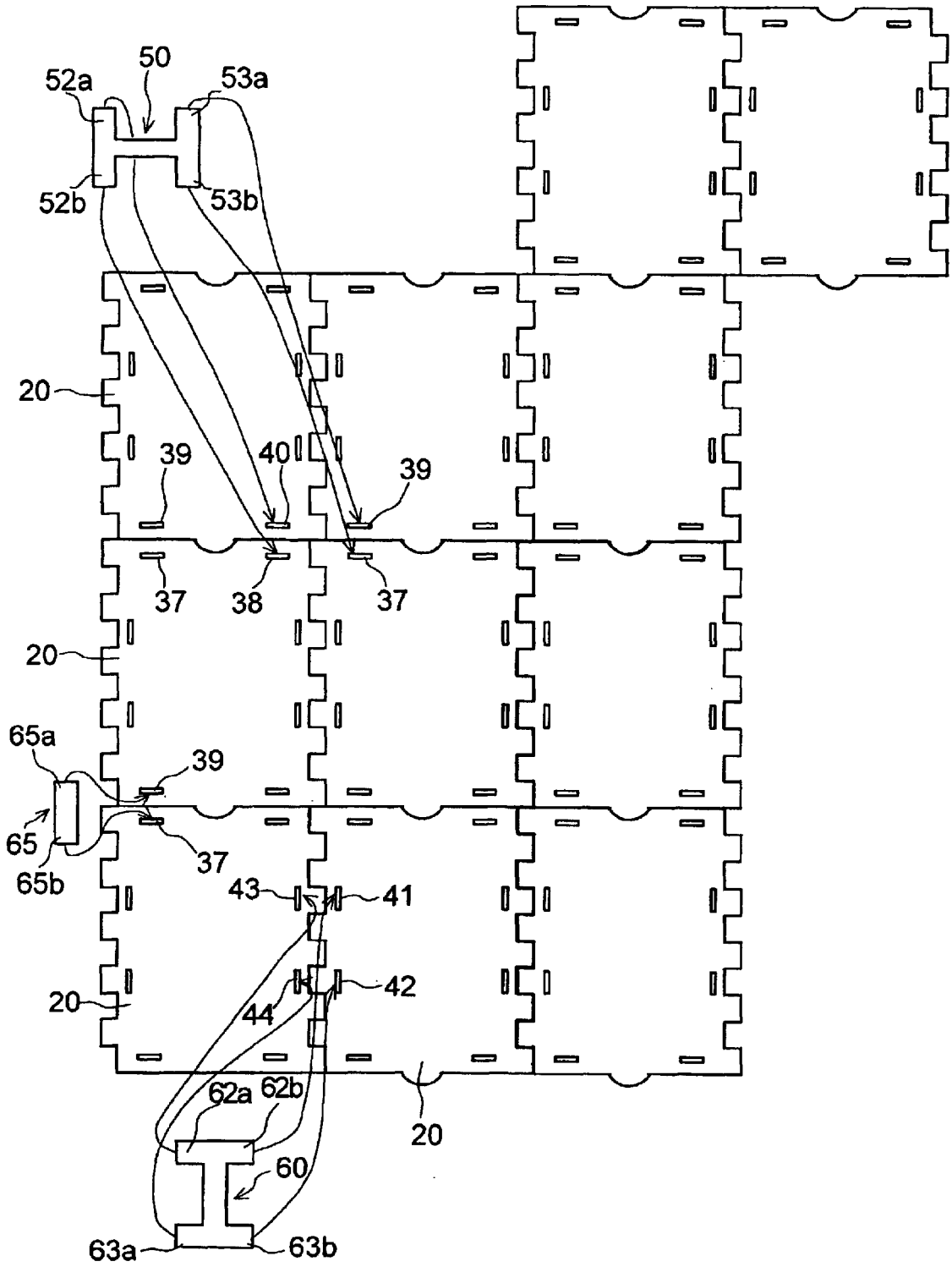
FIG. 5 is a plan view showing the attachment positions of the coupling members to elements of the stab proof vest arranged vertically and horizontally.
Figure 6A:
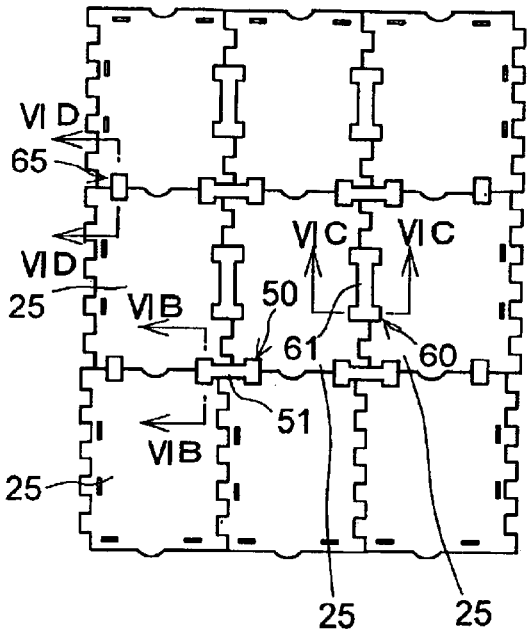
FIG. 6A is a plan view showing the elements of the stab proof vest coupled by the coupling members in the vertical and horizontal directions.
Figure 6B:
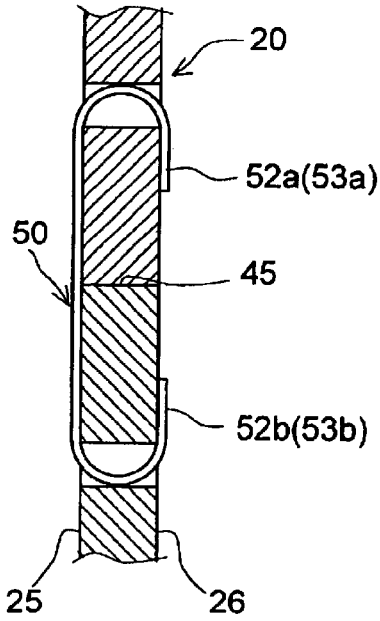
FIG. 6B is a cross sectional view of the coupling member securing the elements of the stab proof vest taken along the line VIB—VIB of FIG. 6A.

To couple four of the elements 20 arranged in two columns and two rows, as shown in FIG. 5, the end portions 53*a* and 53*b* of the arm portion 53 are inserted and press-fitted into the coupling holes 39 and 37, respectively, of the two different elements 20 arranged on a right side. The end portions 52*a* and 52*b* of the arm portion 52 are inserted and press-fitted into the coupling holes 40 and 38, which are in the vicinity of the coupling holes 39 and 37, of the two different elements 20 arranged on a left side, respectively. Thereafter, as shown in FIGS. 6A and 6B, on condition that the main portion 51 is tightly in contact with the front faces 25 of the elements 20, the upper end portions 52*a* and 53*a* and the lower end portions 52*b* and 53*b*, penetrating through the elements 20 and protruding from the rear faces 26 thereof, are folded on either side of the boundary surface 45 between the elements 20 adjacent in the vertical direction, to tightly contact with the rear faces 26. Although the coupling member 50 can be secured to the elements 20 by welding, bonding, or the like, by only inserting and folding the upper end portions 52*a* and 53*a* and lower end portions 52*b* and 53*b*, a coupling between adjacent elements 20 can be maintained due to the rigidity of stainless steel, and also allows bending of the stab proof vest 10 via the coupling members 50 about the boundary surface 45 in accordance with the shape and movement of a wearer's body. Moreover, since a single coupling member (50) can couple the four elements arranged in two columns and two rows, it is possible to efficiently carry out an assembly process.

On the other hand, the coupling member 60 is used for coupling the two adjacent elements 20 in the horizontal direction. The coupling member 60, press-formed into the shape of letter "I" (the same as the shape of letter "H" rotated 90 degrees), includes a rectangular main portion 61 extending vertically, and rectangular arm portions 62 and 63 extending horizontally which are disposed in both ends of the main portion 61. The distance between the arm portions 62 and 63 corresponds with the distance between coupling holes 41 and 42 (the coupling holes 43 and 44). The width of the arm portions 62 and 63 in the vertical direction is substantially the same as the width of the coupling holes 41 to 44.

Figure 6C:
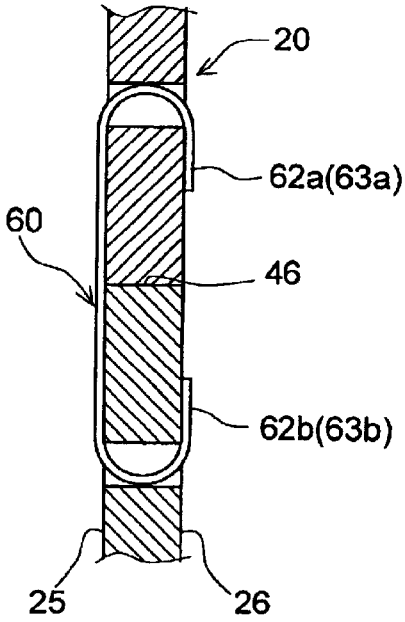
FIG. 6C is a cross sectional view of the coupling member securing the elements of the stab proof vest taken along the line VIC—VIC of FIG. 6A.

To couple the elements 20 arranged in the horizontal direction, as shown in FIG. 5, the left end portions 62*a* and 63*a* of the arm portions 62 and 63 are inserted into the coupling holes 43 and 44 of the element 20 arranged on a left side, respectively. The right end portions 62*b* and 63*b* of the arm portions 62 and 63 are inserted into the coupling holes 41 and 42, which are in the vicinity of the coupling holes 43 and 44, of the element 20 arranged on a right side, respectively. Thereafter, as shown in FIGS. 6A and 6C, on condition that the main portion 61 is tightly in contact with the front faces 25 of the elements 20, the left end portions 62*a* and 63*a* and the right end portions 62*b* and 63*b*, penetrating through the elements 20 and protruding from the rear faces 26 thereof, are folded on either side of the boundary surface 46 between the elements 20 adjacent in the vertical direction, to tightly contact with the rear faces 26. Although the coupling member 60 can be secured to the elements 20 by welding, bonding, or the like, by only inserting and folding the left end portions 62*a* and 63*a* and the right end portions 62*b* and 63*b*, a coupling between adjacent elements 20 can be maintained due to the rigidity of stainless steel, and also allows bending of the stab proof vest 10 via the coupling member 60 about the boundary surface 46 in accordance with the shape and movement of a wearer's body. Although it is possible to couple the elements 20 only by the coupling members 50, it is desirable to use the coupling members 60 also for the purpose of ensuring a secure coupling.

The coupling member 65 is used for vertically coupling the elements 20 arranged in horizontal end portions. The coupling member 65 is press-formed into a rectangular shape extending in the vertical direction.

Figure 6D:
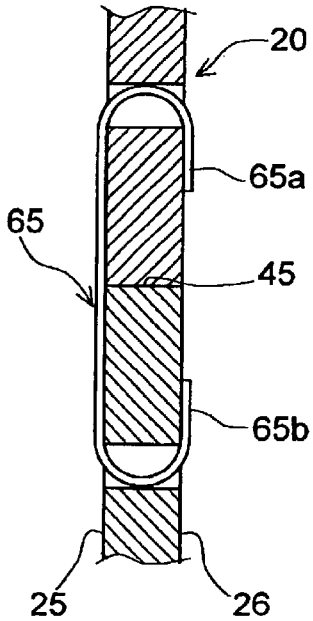
FIG. 6D is a cross sectional view of the coupling member securing the elements of the stab proof vest taken along the line VID—VID of FIG. 6A.

To vertically couple the elements 20 arranged in a horizontal left end portion, as shown in FIG. 5, an upper end portion 65*a* is inserted into the coupling hole 39 of the element 20 arranged on an upper side, and a lower end portion 65*b* is inserted into the coupling hole 37 of the element 20 arranged on a lower side. Likewise, to vertically couple the elements 20 arranged in a horizontal right end portion, the upper end portion 65*a* is inserted into the coupling hole 40 of the element 20 arranged on the upper side, and the lower end portion 65*b* is inserted into the coupling hole 38 of the element 20 arranged on the lower side. Thereafter, as shown in FIGS. 6A and 6D, on condition that the coupling member 65 is tightly in contact with the front faces 25 of the elements 20, the end portions 65*a* and 65*b*, penetrating though the elements 20 and protruding from the rear faces 26 thereof, are folded on either side of the boundary surface 45 between an adjacent elements 20 in the vertical direction, to tightly contact with the rear faces 26. Although the coupling member 65 can be secured to the elements 20 by welding, bonding, or the like, by only inserting and folding the upper and lower end portions 65*a* and 65*b*, a coupling between adjacent elements 20 can be maintained due to the rigidity of stainless steel, and also allows bending of the stab proof vest 10 via the coupling members 65 about the boundary surface 45 in accordance with the shape and movement of a wearer's body. Although it is possible to couple the elements 20 only by the coupling members 50, it is desirable to use the coupling members 65 also, for the purpose of ensuring a secure coupling of the elements 20 in the horizontal end portions. Since the unsecured end portions may cause injury on a wearer, it is also desirable to secure the end portions with the coupling member 65 for safety reasons.

In consideration of resistance to stabbing which prevents a knife edge or tip from penetrating, and ease of bending at the boundary surface 45 or 46, it is desirable that the thickness of the coupling member 50, 60, 65 be 0.5 to 1 mm. The coupling members 50 and 60 can be in a rectangular shape to have the same width as that of the coupling holes 37 to 44. In this case, both ends of the coupling member 50 or 60 are inserted into the coupling holes 37 and 39, the coupling holes 38 and 40, the coupling holes 41 and 43, or the coupling holes 42 and 44. Thereafter, the ends of the coupling member 50 or 60 protruding from the rear face 26 are folded and secured as in the case of the above embodiment. The number of the coupling holes formed in each side of the element 20 can be one, three or more, as long as the adjacent elements 20 are securely coupled with each other.

As described above, surrounding a wearer's body (chest, abdomen, back, and side) with the elements 20 coupled by the coupling members 50, 60, and 65 makes it possible to form the stab proof vest 10 of the present invention which protects the wearer against an attacker possessing a sharp object such as a knife. Since the rectangular elements 20 are coupled vertically and horizontally, and the adjacent elements 20 are bendable, so that the stab proof vest 10 fits the wearer's body. The number of elements 20 coupled in the vertical and horizontal directions is can be appropriately changed in accordance with the physique of the wearer, the area to be protected, etc. In other words, the elements 20 coupled in the vertical direction are addable or detachable in accordance with the size of a chest, and the elements 20 coupled in the horizontal direction are addable or detachable in accordance with height.

As shown in FIG. 7, for example, the elements 20 vertically coupled in a front part 11 corresponding to the front body part and both sides can be larger in number than that in a back body part 12. The end face of the stab proof vest 10 can be straight, as shown in FIG. 7, by omitting the depressions 35 of the elements 20 uppermost in the vertical direction, the projections 36 of the lowermost elements 20, the projections 31 of the elements 20 in the horizontal left end, and the projections 33 of the elements 20 in the horizontal right end. In this case, a wearer and his or her clothes are prevented from damage, because the projections 31, 33, and 36 do not protrude outward. To prevent any physical damage of the wearer, as shown in FIG. 7, it is desirable to round the corner of the element 20 at each corner 14 of the stab proof vest 10. It is desirable to curve the elements 20 as shown in FIG. 1B, and if a radius of curvature of each element 20 is variable in accordance with the position thereof when worn, the stab proof vest 10 provides a more comfortable fit for the wearer and puts less constraint to the wearer's movements.

Figure 8:
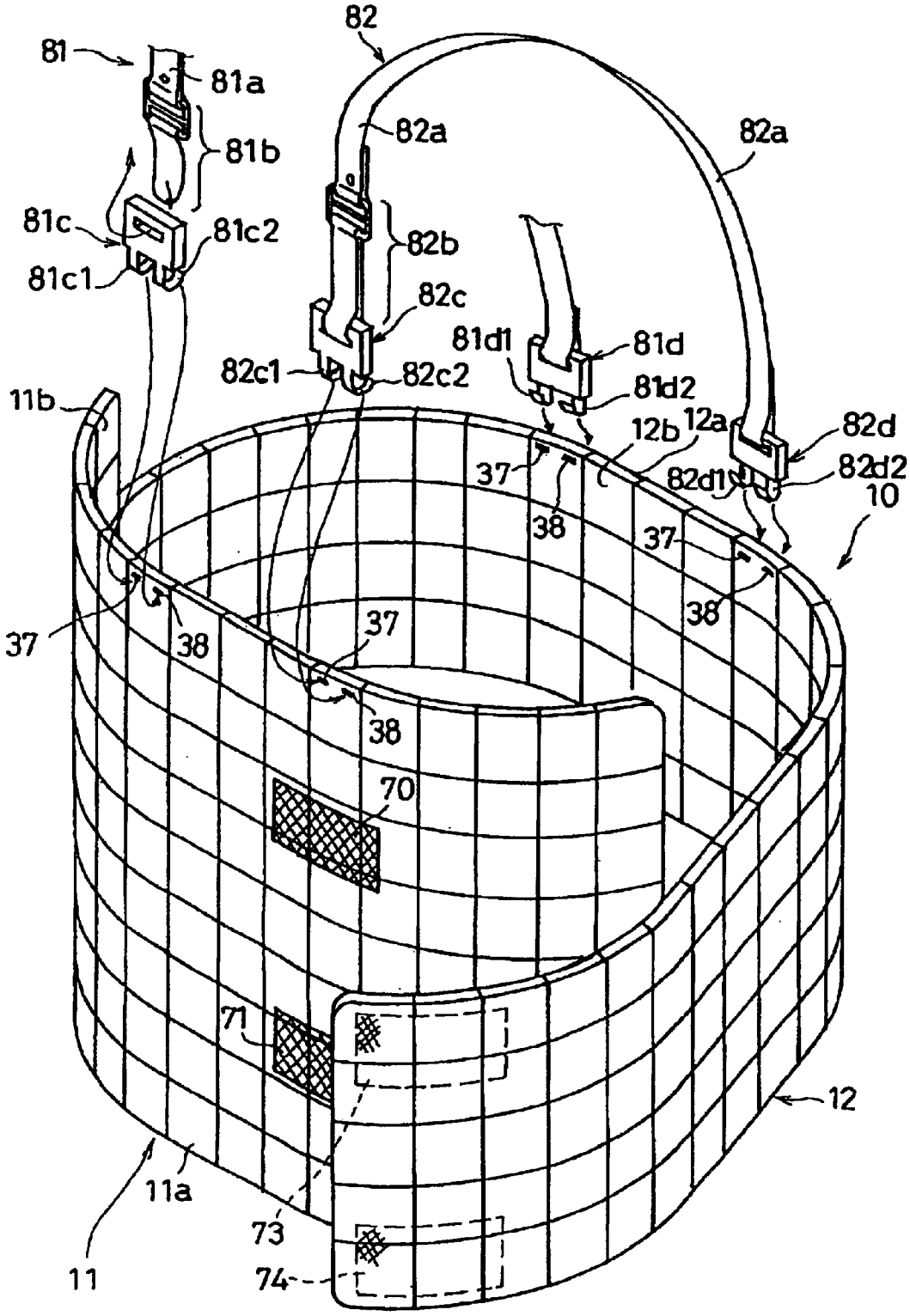
FIG. 8 is a perspective view of the stab proof vest in which hook and loop fasteners and suspension members are attached.

AS shown in FIG. 8, rectangular hook and loop fasteners 70 and 71 have the same shape are disposed on the upper and lower sides in the vertical direction on the front face 11*a* the front part 11. Hook and loop fasteners 73 and 74 are also so disposed in the rear face 12*b* of the back body part 12 as to be opposed to the hook and loop fasteners 70 and 71, when wrapping the wearer's body (upper-body) with the stab proof vest 10. In the fasteners 70 and 71, there are small loops arranged on a base material (not illustrated). In the fasteners 73 and 74, there are small hooks arranged on a base material (not illustrated). By pressing the fasteners 73 and 74 against the fasteners 70 and 71, respectively, the hooks are engaged with the loops to fasten the fasteners 73 and 74 on the fasteners 70 and 71. Accordingly, the wearer's body is wrapped in the stab proof vest 10 so that the front part 11 covers the front and side of the wearer, and then the fasteners 73 and 74 are pressed against the fasteners 70 and 71 to secure the stab proof vest 10. The hooks can be provided in the fasteners 70 and 71, and the loops can be provided in the fasteners 73 and 74. Another type of fastener having the configuration except for the combination of the hooks and loops can be alternatively used. The positions and the number, of the hook and loop fasteners can be optional, as long as the hook and loop fasteners in the front part 11 correspond to those in the back part 12 in position, and the hook and loop fasteners are have the same shape.

To prevent the stab proof vest 10 from dropping, it is desirable to provide suspension members 81 and 82. As shown in FIG. 8, each of the suspension members 81 and 82 includes a belt 81*a* or 82*a*, a length adjusting portion 81*b* or 82*b*, a connecting portion 81*c* or 82*c* connected to one end of the belt 81*a* or 82*a* via the length adjusting portion 81*b* or 82*b*, and a connecting portion 81*d* or 82*d* connected to the other end of the belt 81*a* or 82*a*. When the stab proof vest 10 is worn, the suspension members 81 and 82 are suspended from both shoulders of the wearer. Specifically, hooks 81*c*1 and 81*c*2 provided at the end of the connecting portion 81*c* are inserted into the coupling holes 37 and 38 of the uppermost element 20 in the front part 11 from the side of the front face 11*a*, and then protruding parts of the hooks 81*c*1 and 81*c*2 from a rear face 11*b* are bent upward. Hooks 81*d*1 and 81*d*2 provided at the end of the connecting portion 81*d* are inserted into the coupling holes 37 and 38 of the uppermost element 20 in the back part 12 from the side of the front face 12*a*, and then protruding parts of the hooks 81*d*1 and 81*d*2 from a rear face 12*b* are bent upward, in order to secure the suspension member 81 to the stab proof vest 10. Likewise, in the suspension member 82, hooks 82*c*1 and 82*c*2 provided at the end of the connecting portion 82*c* are inserted into the coupling holes 37 and 38 of the uppermost element 20 in the front part 11 from the side of the front face 11*a*, and then protruding parts of the hooks 82*c*1 and 82*c*2 from a rear face 11*b* are bent upward. Hooks 82*d*1 and 82*d*2 provided at the end of the connecting portion 82*d* are inserted into the coupling holes 37 and 38 of the uppermost element 20 in the back part 12 from the side of the front face 12*a*, and then protruding parts of the hooks 82*d*1 and 82*d*2 from a rear face 12*b* are bent upward, in order to secure the suspension member 82 to the stab proof vest 10.

The suspension members 81 and 82 are disposed in any places of the front part 11 and the back body part 12, in accordance with the physique of the wearer, or preference of the wearer, etc. The belts 81*a* and 82*a* are made of, for example, cloth or leather. The connecting portions 81*c*, 81*d*, 82*c*, and 82*d* are made of material which can suspend the stab proof vest 10 for a long time, such as stainless steel, aluminum, and plastics.

Furthermore, it is desirable to cover the stab proof vest 10 with an elastic member or stretchable member (for example, rubber or cloth), in order to prevent the wearer and his/her clothes from being damaged by the front and rear faces 11*a* and 11*b* of the front part 11, and the front and rear faces 12*a* and 12*b* of the back body part 12. It is desirable to secure the elastic or stretchable member to the stab proof vest 10 by bonding, binding, or the like. The elastic or the stretchable member can cover the whole of the stab proof vest 10, or a part thereof.

In the above-described embodiment, the stab proof vest 10 is constructed from the plurality of elements 20 coupled vertically and horizontally. The stab proof vest 10, however, can be constructed from vertically extending long plates which are coupled in the horizontal direction.

Figure 9:
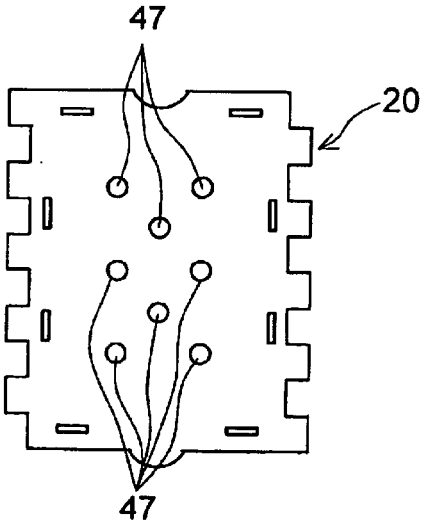
FIG. 9 is a plan view showing the modification of the first embodiment according to the present invention.

As shown in FIG. 9, it is desirable to provide air vents 47 extending through the element 20, in order to dissipate heat accumulated in the stab proof vest 10 with air going through the air vents 47.

In the stab proof vest 10 of the above embodiment, if the elements 20 are vertically coupled in an upward direction to the uppermost elements 20 in addition, the wearer's neck is also protected. In this case, it is desirable to add smaller elements 20 than those wrapped around the body, in order not to constrict the movement of the neck.

If the elements 20 are vertically coupled in a downward direction from the lowermost elements 20 in addition, it is possible to also protect wearer's waist and legs, etc.

Second Embodiment

A second embodiment of the present invention will be hereinafter described. In the second embodiment, identical members to the first embodiment are referred to the same reference numbers. In the second embodiment, the stab proof vest includes elements 90 and 120 shown in FIGS. 10A to 10D, in addition to the elements 20.

Figure 10A:
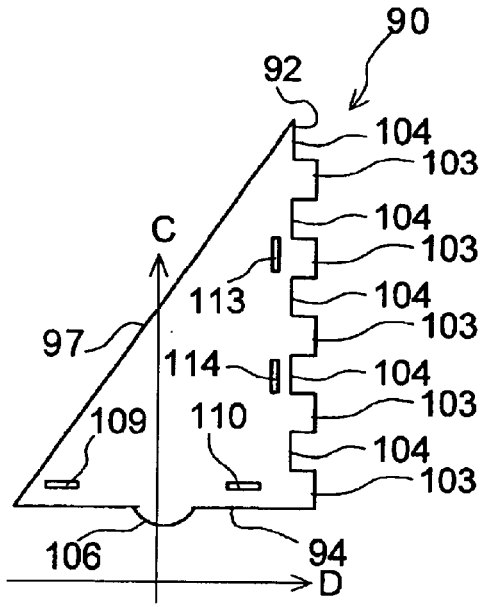
FIG. 10A is a plan view of an element of the stab proof vest, according to a second embodiment of the present invention.
Figure 10B:
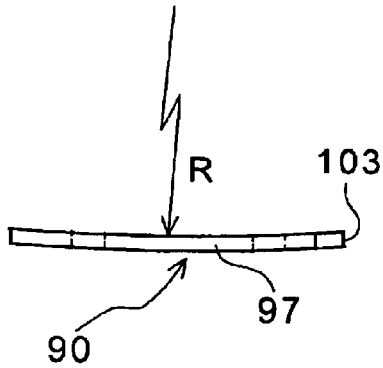
FIG. 10B is a side view of the element of the stab proof vest of FIG. 10A.

As shown in FIGS. 10A and 10B, the element 90 is a stainless steel plate having an approximately right-angled triangular shape which is press-formed. It is desirable for the thickness of the element 90 to be approximately 0.5 to 2 mm, and a range of 0.5 to 1 mm is more desirable. When the thickness of the element 90 is within the above-mentioned range, the wearer can wear the stab proof vest between outerwear and underwear, or under the underwear.

Rectangular projections 103 are provided on a long side 92 of the element 90 along a vertical direction (in direction C of FIG. 10A). The rectangular projections 103 protrude outward in a horizontal direction (along the direction of D of FIG. 10A). A plurality of depressions 104 are formed between the adjacent projections 103.

Figure 11:
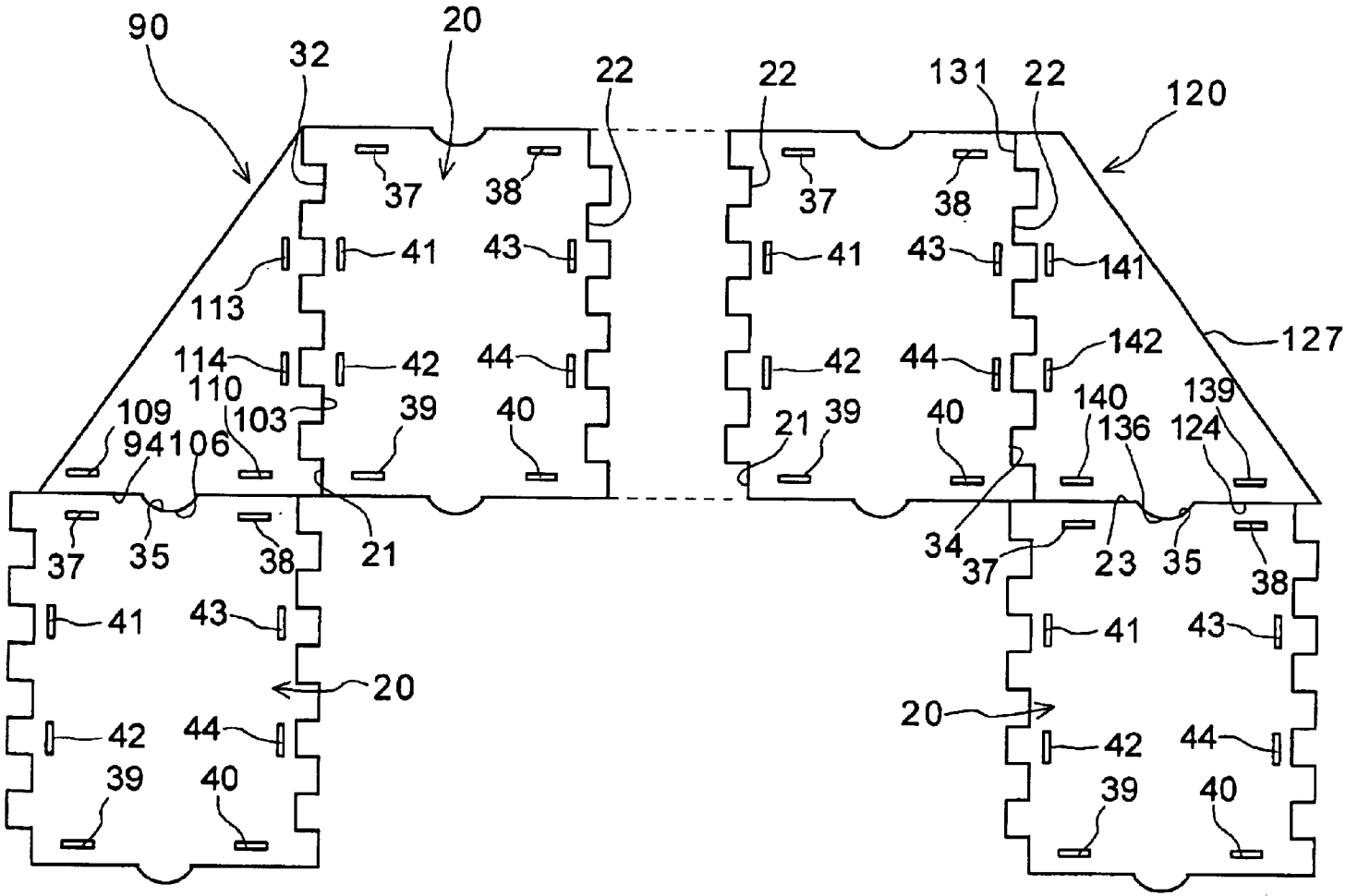
FIG. 11 is a plan view showing the elements of the stab proof vest, according to the second embodiment, which are arranged in the vertical and horizontal directions.

The projections 103 and the depressions 104 are provided alternatively along the long side 92, and the width of the projection 103 in the vertical direction is the same as that of the depression 104. Accordingly, the projections 103 are inserted into and engaged with the depressions 32 of an adjacent element 20, as shown in FIG. 11, so that the element 90 is coupled to the element 20. Since the element 90 is coupled to the element 20 by the engagement between the projection 103 and the depression 32, a linear gap is not left at the boundary between the adjacent elements 90 and 20, so that an edge or tip of a sharp object such as a knife cannot enter through the gap therebetween.

An arc-shaped projection 106, corresponding to the depression 35 of the element 20, is provided at the midpoint of a short side 94 of the element 90 extending in the horizontal direction (refer to FIG. 10A). As shown in FIG. 11, when the projection 106 of the element 90 is vertically inserted into and engaged with the depression 35 of the element 20, the elements 90 and 20 are vertically aligned without leaving any gap. Since the element 90 is coupled to the element 20 by the engagement between the projection 106 and the depression 35, as described above, a linear gap is not left in the boundary between the elements 90 and 20, so that an edge of an edge tool does not enter through the gap. The short side 94 of the element 90 does not fit with the short side 24 of the element 20, so that it is possible to couple the elements 90 and 20 in a correct orientation.

Figure 10C:
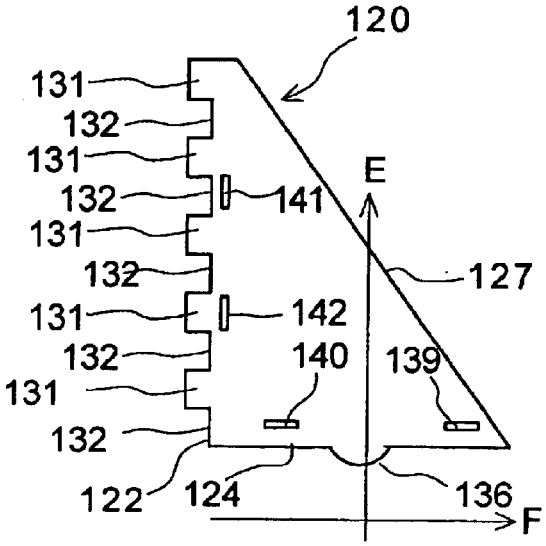
FIG. 10C is a plan view of an element of the stab proof vest according to the second embodiment.
Figure 10D:
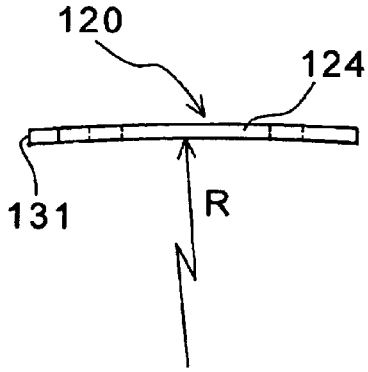
FIG. 10D is a side view of the element of the stab proof vest of FIG. 10C.

The element 120 shown in FIGS. 10C and 10D is a stainless steel plate having an approximately right-angled triangular shape which is press-formed. It is desirable that the thickness of the element 120 is approximately 0.5 to 2 mm, and a range of 0.5 to 1 mm is more desirable. When the thickness of the element 120 is within the above-mentioned range, the wearer can wear the stab proof vest between outerwear and underwear, or under the underwear.

Rectangular projections 131 are provided on a long side 122 of the element 120 along a vertical direction (in direction B of FIG. 10C). The rectangular projections 131 protrude outward in a horizontal direction (along direction F of FIG. 10C). A plurality of depressions 132 are formed between the adjacent projections 131.

The projections 131 and the depressions 132 are provided alternatively along the long side 122, and the width of the projection 131 in the vertical direction is the same as that of the depression 132. Accordingly, the projections 131 are inserted into and engaged with the depressions 34 of an adjacent element 20, as shown in FIG. 11, so that the element 120 is coupled to the element 20. Since the element 120 is coupled to the element 20 by the engagement between the projection 131 and the depression 34, a linear gap is not left at the boundary between the adjacent elements 120 and 20, so that an edge or tip of a sharp object such as a knife cannot enter through the gap therebetween.

An arc-shaped projection 136, corresponding to the depression 35 of the element 20, is provided at the midpoint of a short side 124 of the element 120 extending in the horizontal direction (refer to FIG. 10C). As shown in FIG. 11, when the projection 136 of the element 120 is vertically inserted into and engaged with the depression 35 of the element 20, the elements 120 and 20 are vertically aligned without leaving any gap. Since the element 120 is coupled to the element 20 by the engagement between the projection 136 and the depression 35, as described above, a linear gap is not left in the boundary between the elements 120 and 20, so that an edge of an edge tool does not enter through the gap. The short side 124 of the element 120 does not fit with the short side 24 of the element 20, so that it is possible to couple the elements 120 and 20 in a correct orientation.

As shown in FIG. 10A, coupling holes (holes) 109 and 110 for inserting a coupling member are formed in the lower end portion of the element 90. The coupling holes 109 and 110 are rectangular openings having the same shape. When the element 90 is adjacent to the element 20 in the horizontal direction, the coupling hole 110 is symmetrical to the coupling hole 39 of the element 20 (refer to FIG. 11). When the element 90 is adjacent to the element 20 in the vertical direction, the coupling holes 109 and 110 are symmetrical to the coupling holes 37 and 38 of the element 20, respectively (refer to FIG. 11).

As shown in FIG. 10A, coupling holes 113 and 114 for inserting a coupling member thereinto are formed in the horizontal right end of the element 90. The coupling holes 113 and 114 are rectangular openings having the same shape. When the element 90 is adjacent to the element 20 in the horizontal direction, the coupling holes 113 and 114 are symmetrical to the coupling holes 41 and 42 of the element 20 (refer to FIG. 11). Since the size and shape of the coupling holes 109, 110, 113 and 114 is the same as that of the coupling holes 37 to 44 of the element 20, and the distance between the coupling holes 109 and 110 is the same as the distance between the coupling holes 113 and 114, a common coupling member can be used so that the cost can be reduced.

On the other hand, as shown in FIG. 10C, coupling holes 139 and 140 for inserting a coupling member thereinto are formed in the lower end of the element 120. The coupling holes 139 and 140 are rectangular openings having the same shape. When the element 120 is adjacent to the element 20 in the horizontal direction, the coupling hole 140 is symmetrical to the coupling hole 40 of the element 20 (refer to FIG. 11). When the element 120 is adjacent to the element 20 in the vertical direction, the coupling holes 140 and 139 are symmetrical to the coupling holes 37 and 38 of the element 20 (refer to FIG. 11).

As shown in FIG. 10C, coupling holes 141 and 142 for inserting a coupling member thereinto are formed along the horizontal left end of the element 120. The coupling holes 141 and 142 are rectangular openings having the same shape. When the element 120 is adjacent to the element 20 in the horizontal direction, the coupling holes 141 and 142 are symmetrical to the coupling holes 43 and 44 of the element 20 (refer to FIG. 11). If the shape of the coupling holes 139 to 142 is the same as that of the coupling holes 37 to 44 of the element 20, and the distance between the coupling holes 139 and 140 is the same as the distance between the coupling holes 141 and 142, cost is reduced because a common coupling member can be used.

As in the case of the first embodiment, the coupling members 50, 60, and 65 made of stainless steel shown in FIGS. 4A to 4C are used for coupling the element 90 or 120 to the element 20. How to couple the element 120 is hereinafter described with reference to FIGS. 11 and 12A to 12D. Note that the element 90 is coupled in a like manner.

Figure 12A:
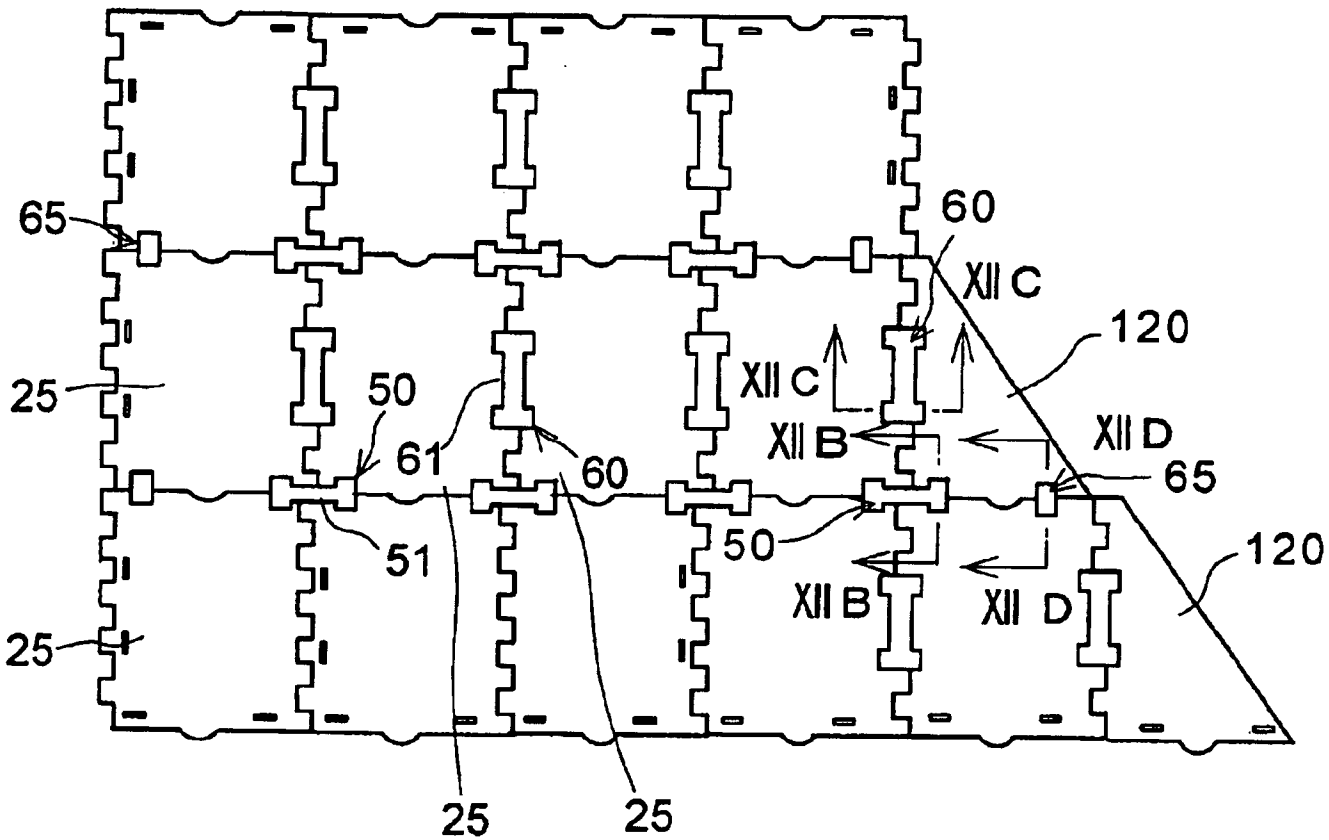
FIG. 12A is a plan view showing the elements of the stab proof vest, according to the second embodiment, which are coupled by the coupling members in the vertical and horizontal directions.
Figure 12B:
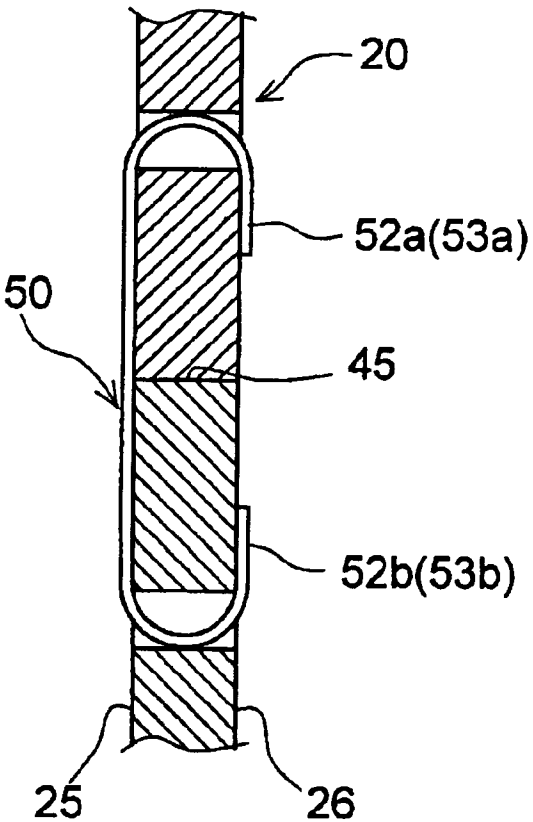
FIG. 12B is a cross sectional view of the coupling member securing the elements of the stab proof vest taken along the line XIIB—XIIB of FIG. 12A.

To couple the element 120 to the element 20 adjacent in the vertical direction, as shown in FIGS. 11, 12A and 12B, the end portions 52*a* and 52*b* (or the end portions 53*a* and 53*b*) of the arm portion 52 of the coupling member 50 is inserted (press-fitted) into the coupling holes 140 and 37, respectively. Thereafter, as shown in FIGS. 11, 12A and 12D, the upper end portion 65*a* of the coupling member 65 is inserted into the coupling hole 139 of the element 120 arranged on an upper side, and the lower end portion 65*b* thereof is inserted into the coupling hole 38 of the element 20 arranged on a lower side, to securely couple the elements 120 and 20 together.

Figure 12C:
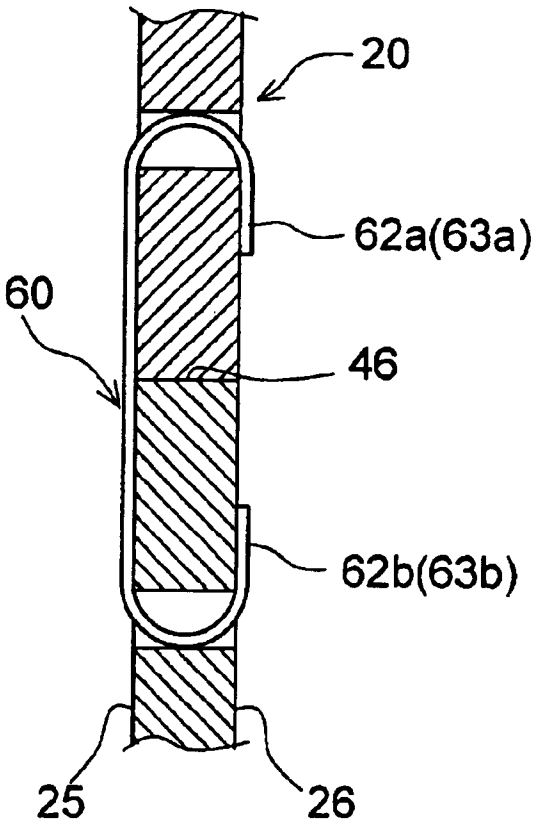
FIG. 12C is a cross sectional view of the coupling member securing the elements of the stab proof vest taken along the line XIIC—XIIC of FIG. 12A.
Figure 12D:
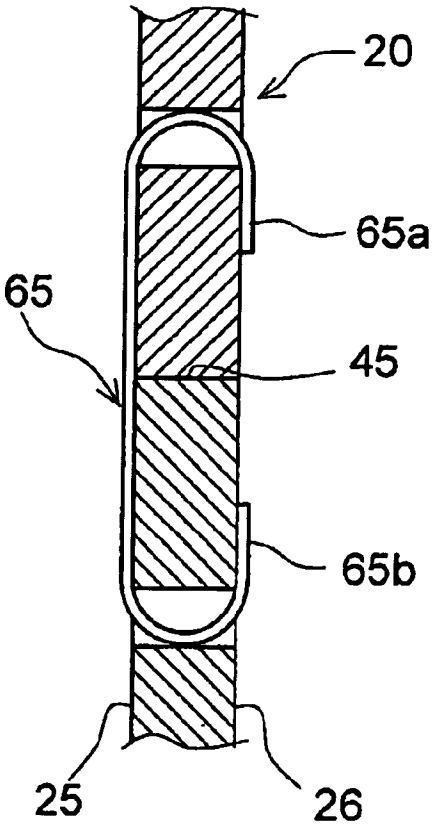
FIG. 12D is a cross sectional view of the coupling member securing the elements of the stab proof vest taken along the line XIID—XIID of FIG. 12A.

On the other hand, to couple the element 120 to the element 20 adjacent in the horizontal direction, as shown in FIGS. 11, 12A and 12C, the left end portions 62*a* and 63*a* of the arm portions 62 and 63 are inserted into the coupling holes 43 and 44 of the element 20 arranged on a left side, and the right end portions 62*b* and 63*b* of the arm portions 62 and 63 are inserted into the coupling holes 141 and 142, which are in the vicinity of the coupling holes 43 and 44, of the element 120 arranged on a right side, respectively.

Figure 13:
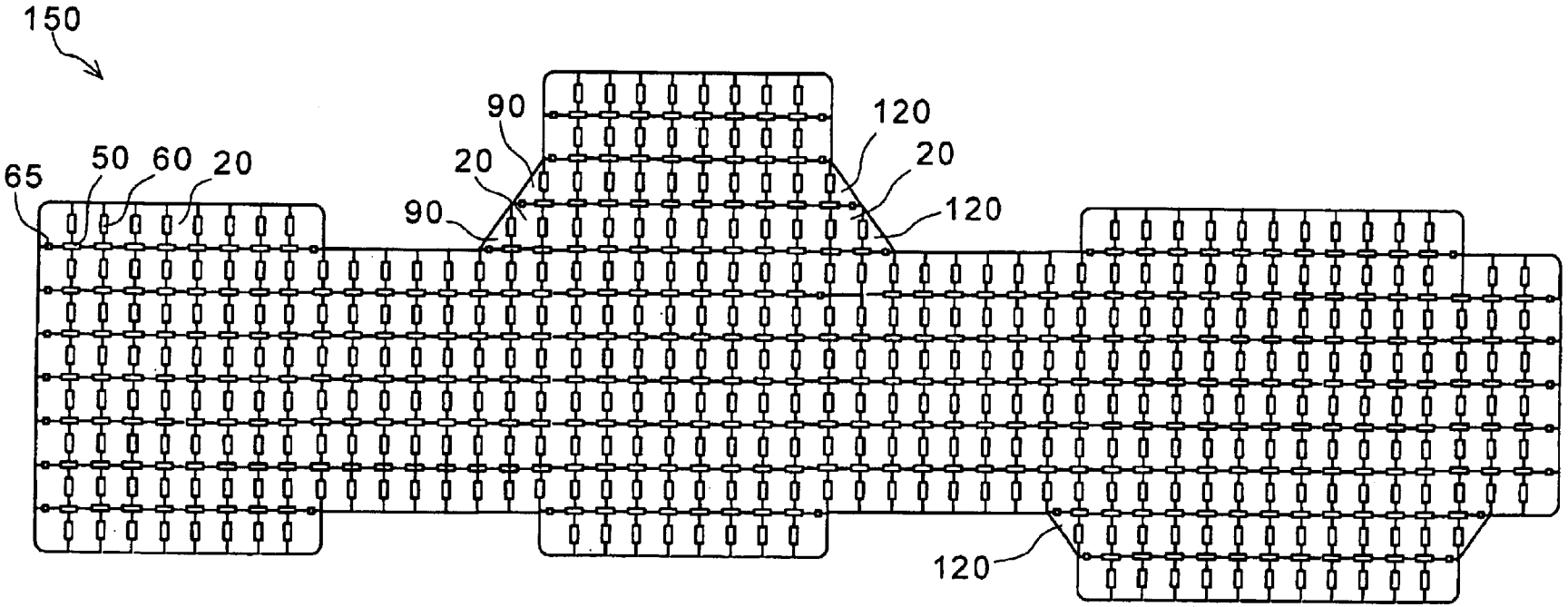
FIG. 13 is a plan view of a stab proof vest, according to the second embodiment, in which the elements of the stab proof vest are completely coupled.

As shown in FIG. 13, it is possible to couple the elements 90 and 120 to one of the elements 20 to which another element 20 cannot be coupled. Therefore, a stab proof vest 150 having such a configuration according to the second embodiment can protect a greater portion of the wearer.

Figure 14:
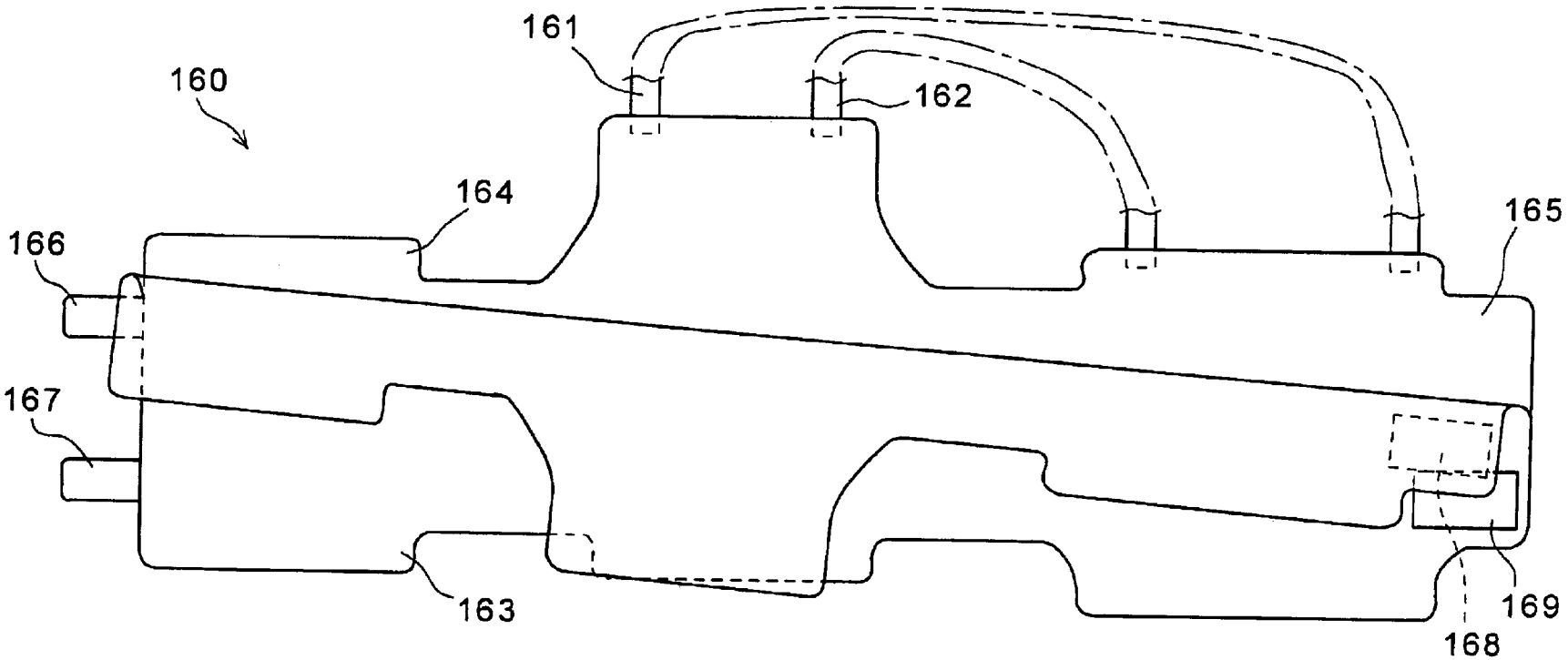
FIG. 14 is an explanatory view of a cover according to the second embodiment.

The suspension members 81 and 82 can be directly attached to the elements 20 of the stab proof vest 150, as in the first embodiment. Suspension members 161 and 162, as shown in FIG. 14, can be sewed on a cloth cover 160 which contains the stab proof vest 150. Since a wearer suspends the suspension members 161 and 162 from his/her shoulders, the stab proof vest 15 is prevented from dropping. The cover 160 contains the stab proof vest 150 in a space 165 between a front portion 163 and a back portion 164 sewed together. After a wearer's body is wrapped with the cover 160, hook and loop fasteners 166 and 167 are pressed against hook and loop fasteners 168 and 169, respectively, to fix the stab proof vest 150 therewithin. The cover 160 can be applied to the stab proof vest 10 according to the first embodiment. The stab proof vest 150 can be composed of elastic members or stretchable members (for example, rubber or cloth).

The configuration, operation, effect, and modification of the second embodiment are the same as those of the first embodiment except for those mentioned above.

Third Embodiment

In the third embodiment, identical members to the first and second embodiments are referred by the same reference numbers.

Figure 15:
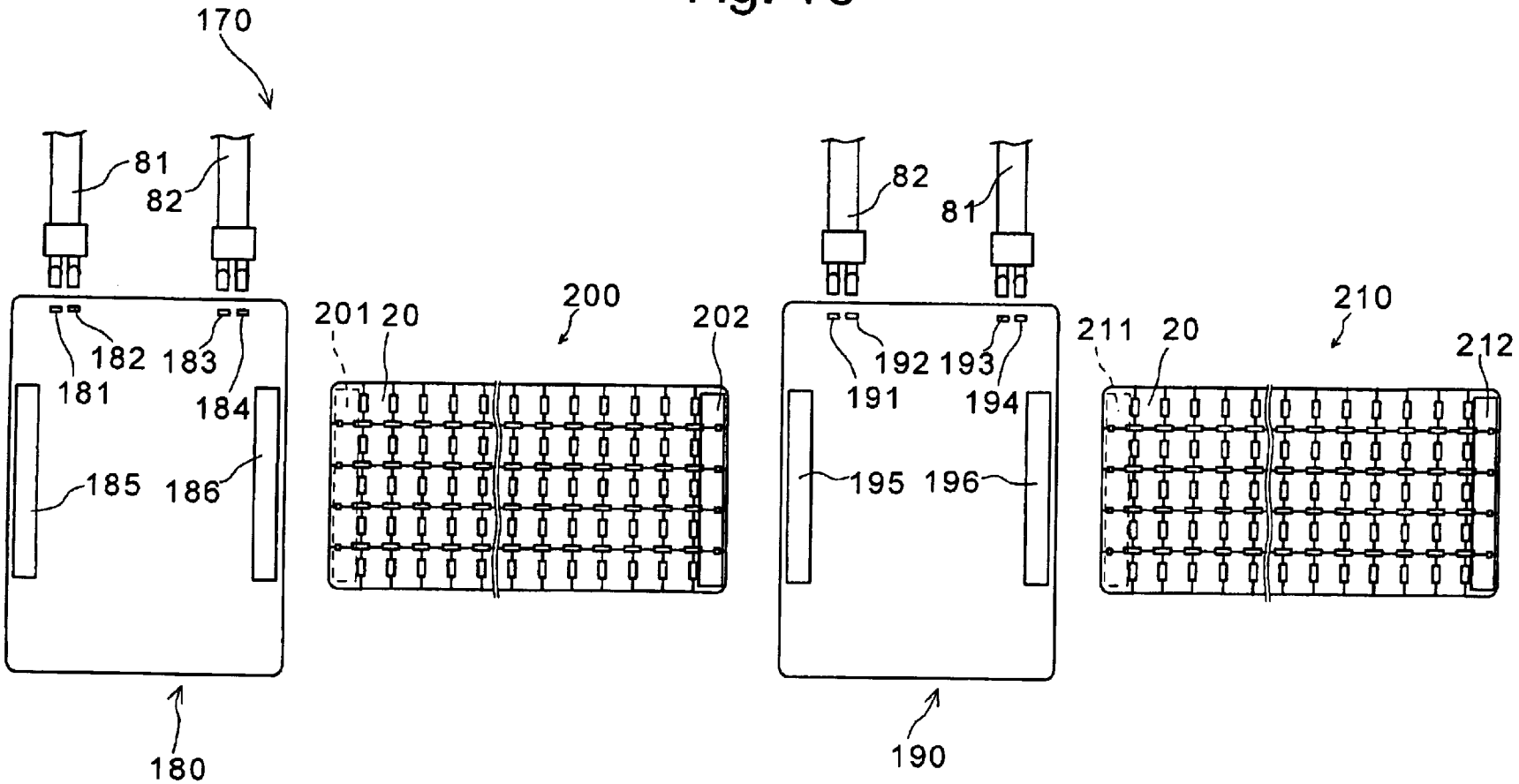
FIG. 15 is a plan view of a stab proof vest according to a third embodiment of the present invention.

In a stab proof vest 170 according to the third embodiment, as shown in FIG. 15, plate members 190 and 190 are provided for wearing on the front body portion and the back body portion, respectively. The plate members 180 and 190 are connected by connection members 200 and 210, each of which is constructed from the elements 20 coupled vertically and horizontally.

Each of the plate members 180 and 190 in the shape of an approximately rectangle is press-formed from stainless steel. It is desirable that the thickness of the plate members 180 and 190 is approximately 0.5 to 2 mm, as in the case of the element 20. A range of 0.5 to 1 mm is more desirable. Although the plate members 180 and 190 are made of stainless steel in this embodiment, the members can be made of, for example, aluminum, acryl resin, polycarbonate, CFRP (carbon fiber reinforced plastic), GFRP (glass fiber reinforced plastic), or fiber having special configuration, as long as the material has both resistance to stabbing and is light weight.

Connection slots 181 and 182 for attaching the suspension member 81 and connection slots 183 and 184 for attaching the suspension member 82 are formed in the upper portion of the plate member 180 in a vertical direction. Connection slots 193 and 194 for attaching the suspension member 81 and the connection slots 191 and 192 for attaching the suspension member 82 are formed in the upper portion of the plate member 190 in the vertical direction. Hook and loop fasteners 185 and 186 are glued on both ends of the plate member 180 in the horizontal direction, and hook and loop fasteners 195 and 196 are glued on both ends of the plate member 190.

On the other hand, hook and loop fasteners 201 and 202 are glued on both ends of the connection member 200 in the horizontal direction, and hook and loop fasteners 211 and 212 are glued on both ends of the connection member 210. Pressing the fasteners 201, 202, 211 and 212 against the fasteners 186, 195, 196, and 185 makes it possible to assemble the stab proof vest 170.

It is difficult to make the single plate member fit with the side of a wearer. According to the stab proof vest 170 having the above configuration, however, the flexible connection members 200 and 210 can securely protect the sides of the wearer. Adopting the plate members 180 and 190 in the front and back body parts, instead of the coupled elements 20, makes it possible to reduce a process for coupling the elements 20. Therefore, manufacturing cost is reduced.

In the third embodiment, both of the plate members 180 and 190 are provided for wearing on the front and back body portions. One of the plate members 180 and 190 can be exchanged with a connection member, such as the connection members 200 and 210, which includes the elements 20 coupled vertically and horizontally. The configuration, operation, effect, and modification of the third embodiment are the same as those of the first and second embodiments, except for those mentioned above.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A stab proof vest, wherein at least a portion of said stab proof vest comprises:

a plurality of elements; and a coupling member for coupling adjacent said elements together, wherein each side of said elements is provided with at least one projection and at least one depression adjacent to said projection, and a coupling hole into which said coupling member is inserted, wherein the projection of one of said element is engaged with the depression of an adjacent said element, and wherein said common coupling member is inserted into each said hole of adjacent said elements and is secured thereto in order to couple said adjacent elements.

2. The stab proof vest according to claim 1, wherein said coupling member couples four said elements arranged in two columns and two rows.

3. The stab proof vest according to claim 1, wherein the stab proof vest is fastened by hook and loop fasteners provided on front and back faces of said stab proof vest.

4. The stab proof vest according to claim 1, wherein the element is made of stainless steel.

5. The stab proof vest according to claim 1, wherein said element is provided with an air vent.

6. The stab proof vest according to claim 1, wherein the projection and the depression are asymmetrically provided on at least one of two pairs of opposite sides of said element.

7. The stab proof vest according to claim 1, wherein the coupling member comprises:

a rectangular main portion; and arm portions provided at both ends of said main portion and extending perpendicularly to said main portion, wherein said coupling member has a shape of a letter "H."

8. The stab proof vest according to claim 7, wherein two of said coupling holes are formed in each side of said element, and wherein said arm portions of said coupling member are inserted into the coupling holes to couple adjacent said elements together.

9. The stab proof vest according to claim 1, wherein the coupling member is made of stainless steel.

10. The stab proof vest according to claim 1, wherein at least a portion of the stab proof vest is covered with an elastic member.

11. The stab proof vest according to claim 1, wherein a thickness of said element is in a range of 0.5 mm to 2 mm.

12. The stab proof vest according to claim 1, wherein each of said elements has the same shape.

13. The stab proof vest according to claim 1, wherein at least one of a front body portion and a back body portion comprises a single plate member.

* * * * *